United States Patent [19]

Knapp

[11] Patent Number: 4,511,368

[45] Date of Patent: Apr. 16, 1985

[54] CORROSION INHIBITORS FOR ALCOHOL-BASED FUELS

[75] Inventor: Gordon G. Knapp, Baton Rouge, La.

[73] Assignee: Ethyl Corporation, Richmond, Va.

[21] Appl. No.: 621,777

[22] Filed: Jun. 18, 1984

[51] Int. Cl.[3] ..... C10L 1/22

[52] U.S. Cl. ..... 44/53; 44/56; 44/63; 44/70; 44/66

[58] Field of Search ..... 44/53, 56, 63, 70, 66; 252/392

[56] References Cited

U.S. PATENT DOCUMENTS

| | | | |
|---|---|---|---|
| 2,632,695 | 3/1953 | Landis et al. | 44/66 |
| 2,919,979 | 1/1960 | Martin et al. | 44/66 |
| 2,948,598 | 8/1960 | Brehm | 44/66 |
| 3,337,472 | 8/1967 | Littler et al. | 44/63 |
| 4,185,594 | 1/1980 | Perilstein | 44/66 |
| 4,305,730 | 12/1981 | Davis et al. | 44/66 |

*Primary Examiner*—Y. Harris-Smith

*Attorney, Agent, or Firm*—Donald L. Johnson; John F. Sieberth; W. G. Montgomery

[57] ABSTRACT

Corrosion caused by gasohol or alcohol motor fuels is inhibited by the addition of a corrosion inhibiting amount of the combination of (A) a polymer of one or more $C_{16}$ to $C_{18}$ polyunsaturated aliphatic monocarboxylic acid (e.g. linoleic dimer and/or trimer) and (B) a substituted imidazoline, e.g., 2-heptadecenyl-1-(2-hydroxyethyl)imidazoline.

9 Claims, No Drawings

CORROSION INHIBITORS FOR ALCOHOL-BASED FUELS

BACKGROUND

In the past, metal corrosion caused by conventional motor fuels such as gasoline was not much of a problem because such hydrocarbon fuels are inherently non-corrosive. However, with the advent of fuels containing alcohols such as gasohol or straight alcohol fuels, corrosion has become a major problem because such fuels are corrosive. It has been reported that this corrosion is due to the presence of acidic contaminants in such fuels such as formic acid. It is almost impossible to avoid such contaminants because they occur in fuel grade alcohols and are also found in storage as normal alcohol oxidation products.

It is known from U.S. Pat. No. 4,305,730 that polymerized linoleic acid, especially trimer, is an effective corrosion inhibitor for alcohol-type motor fuels. It has now been discovered that the corrosion inhibiting properties of such polymerized polyunsaturated aliphatic monocarboxylic acids are improved by use of the co-additives described herein. The substituted imidazoline co-additives of the invention, more fully described hereafter, also are known compounds which heretofore have found use, for example, in motor fuel compositions to prevent carburetor icing as disclosed in U.S. Pat. No. 3,036,902.

SUMMARY

According to the present invention, metal corrosion caused by alcohol-type motor fuels is inhibited by adding to the fuel a combination of (A) polymerized polyunsaturated aliphatic monocarboxylic acid and (B) substituted imidazoline.

DESCRIPTION OF PREFERRED EMBODIMENTS

The invention provides a liquid fuel adapted for use in an internal combustion engine said fuel comprising from 5 to 100 weight percent of one or more alcohols, from 0 to 95 weight percent gasoline and a corrosion inhibiting amount of the combination of (A) a polymer of one or more $C_{16}$ to $C_{18}$ polyunsaturated aliphatic monocarboxylic acids and (B) a substituted imidazole.

The additive combination of this invention can be beneficial in any engine fuel containing or consisting of an oxygenate. Such fuels include gasoline-alcohol mixtures referred to as "gasohol" as well as straight alcohol fuels. Useful alcohols are methanol, ethanol, n-propanol, isopropanol, 1-butanol, 2-butanol, t-butanol, 2-methyl-2-propanol, isobutanol, mixtures thereof such as methanol and t-butanol and the like. Gasohols usually contain about 2 to 30 volume percent alcohol. At concentrations above 10 volume percent phase separation problems are encountered especially in the presence of water.

Phase separation can be minimized by including co-solvents in the gasohol such as ethers, ketones, esters and the like. An especially useful co-solvent is methyl tert-butyl ether which also serves to increase octane value.

The additive combination may be used at a concentration which provides the required amount of corrosion protection. A useful range is about 1 to 5000 pounds per thousand barrels (ptb). A more preferred range is about 5 to 2000 ptb and the most preferred concentration is 5 to 500 ptb.

Component A is a polymer of one or more 16 to 18 carbon polyunsaturated aliphatic monocarboxylic acids. Examples of these are tall oil fatty acid, oleic acid, linoleic acid and linolenic acid including mixtures thereof. The polymers comprise mainly dimers and trimers of the polyunsaturated acids. Suitable polymers of linoleic acid are available commercially. Mixtures high in trimer content are most preferred.

Component B of the combination is a substituted imidazoline.

The substituted imidazoline used in this invention can be represented by the following general structure:

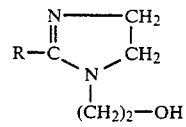

(I)

in which R is a hydrocarbon alkenyl group having from about 7 to about 24 carbon atoms.

The imidazolines having Formula I which are useful in this invention are readily obtained by reacting suitable organic acids with N-(2-hydroxyethyl)ethylene diamine. This reaction involves the elimination of 2 molecules of water between the acid and the amine. This reaction is represented by the following equation:

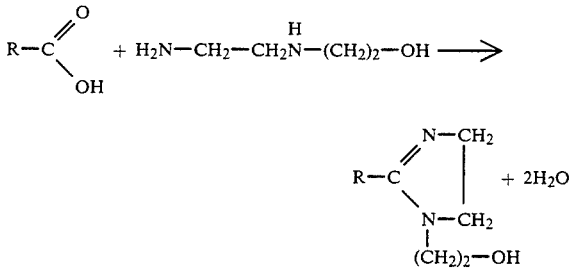

In addition to the imidazoline, small amounts of a corresponding linear amino amide are also obtained. This amino amide is the result of eliminating only one molecule of water between the acid and the amine. Methods of preparing the imidazolines are well known. Useful procedures are described in Wilson, U.S. Pat. No. 2,267,965, and Wilkes, U.S. Pat. No. 2,214,152. As can be seen from the reaction equation given above, the R group in the imidazoline is the alkenyl residue of the particular acid which is used in its preparation. In other words, the R group will have one carbon atom less than the acid which is used to prepare the imidazoline.

Acids which are useful in preparing the imidazolines are hydrocarbon mono-carboxylic acids having up to about 20 carbon atoms. The preferred acids are unsaturated organic acids such as 9,10 decylenic acid, octenoic acid, oleic acid, linoleic acid and the like. Preferred acids are commonly obtained as hydrolysis products of natural materials. These acids thus obtained are mixtures. For example, acids obtained from olive oil, typically, are a mixture of about 83 percent oleic acid, 6 percent palmitic acid, 4 percent stearic acid and 7 percent linoleic acid. This mixture is quite useful for preparing imidazolines to be used in this invention. Organic acid mixtures obtained on saponifying and acidulating babassu oil, castor oil, peanut oil, palm oil and the like, are examples of useful acids. Several imidazoline compounds which can be used in the present invention are available commercially. A preferred imidazoline is 2-heptadecenyl-1-(2-hydroxyethyl)imidazoline.

The weight ratio of component A to component B in the combination can vary over a wide range such as 1 to 10 parts A to 1 to 10 parts B. In a more preferred embodiment, the weight ratio is about 0.5–5 parts component A for each part component B. In a still more preferred embodiment there are 0.6–4.0 parts component A per each part component B. The most preferred ratio is 1:1.

Components A and B can be separately added to the fuel. More preferably components A and B are premixed to form a package and this package is added to the fuel in an amount sufficient to provide the required degree of corrosion protection.

Most preferably components A and B are also premixed with a solvent to make handling and blending easier. Suitable solvents include alcohols (e.g., methanol, ethanol, isopropanol), ketones (acetone, methyl ethyl ketone), esters (tert-butyl acetate) and ethers (e.g., methyl tert-butyl ether).

Aromatic hydrocarbons are very useful solvents. These include benzene, toluene, xylene and the like. Excellent results can be obtained using xylene.

The concentration of the active components A and B in the package can vary widely. For example, the active content can range from about 5 weight percent up to the solubility limit of A or B in the solvent. With xylene, a total active content of about 5–60 weight percent is generally used, especially about 50 weight percent.

Tests were conducted to measure the anti-corrosion properties of the additive combination. In the tests, the corrosion of steel cylinder rods ($\frac{1}{8}$ in.×3 in.) semisubmersed in test fluid was measured under different test conditions. The rods were first cleaned with carborundum 180, polished with crocus cloth, washed with acetone and then dried at room temperature.

Each rod was weighed and then semisubmersed in 10 milliters of the test fluid in a sealed bottle for the specified time at the specified temperature.

At the end of the test period, the rods were removed from the fuel, and after loose deposits were removed with a light brush, the rods were washed and dried as at the start of the test and then reweighed. Any change in rod weight was recorded. Loss of weight indicated corrosion.

A series of three tests were carried out lasting 7 days, 14 days and 30 days, respectively. The series of tests were conducted in fuels comprising 5 volume percent methanol and 5 volume percent t-butanol in gasoline (indolene) containing 0.5 weight percent of 5.0 percent acetic acid in water. The tests were conducted at 25° C.

The test additives added to the test fuels were equal weight mixtures (100 ptb) of either predominantly oleic acid dimer or predominantly oleic acid trimer in combination with 2-heptadecenyl-1-(2-hydroxyethyl)imidazoline and 50 ptb of each individual component.

The results of these tests which are set out in the table below demonstrate the excellent anticorrosion properties of a fuel containing an additive combination of the invention.

TABLE

| Additives | Weight reduction (mg.) |
|---|---|
| **7-DAY TESTS** | |
| None | 7.5 |
| 2-heptadecenyl-l-(2-hydroxyethyl)imidazoline | 5.6 |
| oleic acid dimer | 1.7 |
| oleic acid trimer | 1.8 |
| 2-heptadecenyl-l-(2-hydroxyethyl)imidazoline + oleic acid dimer | 1.1 |
| 2-heptadecenyl-l-(2-hydroxyethyl)imidazoline + oleic acid trimer | 0.5 |
| **14-DAY TESTS** | |
| none | 10.3 |
| 2-heptadecenyl-l-(2-hydroxyethyl)imidazoline | 5.7 |
| oleic acid dimer | 3.7 |
| oleic acid trimer | 4.7 |
| 2-heptadecenyl-l-(2-hydroxyethyl)imidazoline + oleic acid dimer | 0.4 |
| 2-heptadecenyl-l-(2-hydroxyethyl)imidazoline + oleic acid trimer | 0.1 |
| **30-DAY TESTS** | |
| none | 12.1 |
| 2-heptadecenyl-l-(2-hydroxyethyl)imidazoline | 4.4 |
| oleic acid dimer | 6.5 |
| oleic acid trimer | 9.3 |
| 2-heptadecenyl-l-(2-hydroxyethyl)imidazoline + oleic acid dimer | 1.1 |
| 2-heptadecenyl-l-(2-hydroxyethyl)imidazoline + oleic acid trimer | 0.2 |

I claim:

1. A liquid fuel adapted for use in an internal combustion engine, said fuel consisting essentially of 5 to 100 weight percent of one or more alcohols, 0 to 95 weight percent gasoline and a corrosion inhibiting amount of a combination of (A) a polymer of one or more $C_{16}$ to $C_{18}$ polyunsaturated aliphatic monocarboxylic acids and (B) at least one substituted imidazoline having the structural formula:

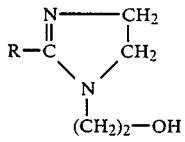

in which R is a hydrocarbon alkenyl group having from about 7 to about 24 carbon atoms.

2. A liquid fuel of claim 1 wherein said polymer of one or more $C_{16}$ to $C_{18}$ polyunsaturated aliphatic monocarboxylic acids comprises mainly linoleic acid dimer, trimer or mixtures thereof.

3. A liquid fuel of claim 2 wherein said substituted imidazoline is 2-heptadecenyl-1-(2-hydroxyethyl-)imidazoline.

4. A corrosion inhibitor concentrate consisting essentially of a solvent containing 5 to 60 weight percent of a combination of (A) a polymer of one or more $C_{16}$ to $C_{18}$ polyunsaturated aliphatic monocarboxylic acids and (B) at least one substituted imidazoline having the structural formula:

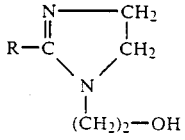

in which R is a hydrocarbon alkenyl group having from about 7 to about 24 carbon atoms.

5. A concentrate of claim 4 wherein said polymer of one or more $C_{16}$ to $C_{18}$ polyunsaturated aliphatic monocarboxylic acids comprises mainly linoleic acid dimer, trimer or mixtures thereof.

6. A concentrate of claim 5 wherein said substituted imidazoline is 2-heptadecenyl-1-(2-hydroxyethyl-)imidazoline.

7. A liquid fuel adapted for use in an internal combustion engine, said fuel consisting essentially of a major amount of a hydrocarbon distillate in the gasoline distillation range and from about 2 to about 30 volume percent of one or more alkanols containing from 1 to about 4 carbon atoms and a corrosion inhibiting amount of a combination of (A) a polymer of one or more $C_{16}$ to $C_{18}$ polyunsaturated aliphatic monocarboxylic acids and (B) at least one substituted imidazoline having the structural formula:

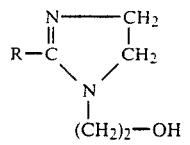

in which R is a hydrocarbon alkenyl group having from about 7 to about 24 carbon atoms.

8. A liquid fuel of claim 7 wherein said polymer of one or more $C_{16}$ to $C_{18}$ polyunsaturated aliphatic monocarboxylic acids comprises mainly linoleic acid dimer, trimer or mixtures thereof.

9. A liquid fuel of claim 8 wherein said substituted imidazoline is 2-heptadecenyl-1-(2-hydroxyethyl-)imidazoline.

* * * * *